US006027313A

United States Patent [19]

Uthe

[11] Patent Number: 6,027,313

[45] **Date of Patent: *Feb. 22, 2000**

[54] GAS ASSISTED FLUID DELIVERY SYSTEM

[75] Inventor: Michael Uthe, Corcoran, Minn.

[73] Assignee: Enhanced Energy, Inc., Minnetonka, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/876,028

[22] Filed: Jun. 13, 1997

[51] Int. Cl.[7] ..... F04F 1/18

[52] U.S. Cl. ..... 417/117; 417/61; 417/109

[58] Field of Search ..... 417/61, 90, 109, 417/117, 279

[56] References Cited

U.S. PATENT DOCUMENTS

| | | | |
|---|---|---|---|
| 1,672,198 | 6/1928 | Boving | 417/61 |
| 1,793,193 | 2/1931 | Price | 417/117 |
| 2,312,455 | 3/1943 | Trawick | 417/117 |
| 3,223,243 | 12/1965 | Muller . | |
| 3,556,301 | 1/1971 | Smith . | |
| 3,690,463 | 9/1972 | O'Brien . | |
| 3,727,766 | 4/1973 | Horne et al. . | |
| 3,762,557 | 10/1973 | Tudor et al. . | |
| 4,663,037 | 5/1987 | Breslin . | |
| 4,700,716 | 10/1987 | Kasevich et al. . | |
| 4,776,086 | 10/1988 | Kasevich et al. . | |
| 4,998,585 | 3/1991 | Newcomer et al. . | |
| 5,059,312 | 10/1991 | Galletti . | |
| 5,065,819 | 11/1991 | Kasevich . | |
| 5,078,213 | 1/1992 | Canutt . | |
| 5,143,629 | 9/1992 | Lint . | |
| 5,152,341 | 10/1992 | Kasevich . | |
| 5,234,580 | 8/1993 | Murphy . | |
| 5,292,433 | 3/1994 | Fletcher et al. . | |
| 5,514,266 | 5/1996 | O'Brien et al. . | |

*Primary Examiner*—Charles G. Freay
*Assistant Examiner*—Cheryl J. Tyler
*Attorney, Agent, or Firm*—Fredrikson & Byron, P.A.

[57] ABSTRACT

A fluid delivery system includes a pump, a fluid conduit and a regulated gas inlet. The fluid conduit has an upper end connected to the pump and a lower end in communication with a fluid supply. The regulated gas inlet includes a gas supply at a first pressure; a pressure monitoring conduit in fluid communication with the fluid conduit between its upper and lower ends; a gas delivery conduit in communication with the fluid conduit; and a pressure-responsive valve. The valve is connected to the pressure monitoring conduit and moves between a closed position wherein gas flow into the fluid conduit is restricted, and at least one open position wherein gas is delivered to the fluid conduit through the gas supply conduit. The valve is normally biased toward the closed position but moves opens when pressure within the pressure monitoring conduit is below the first pressure by more than a predetermined level.

26 Claims, 5 Drawing Sheets

GAS ASSISTED FLUID DELIVERY SYSTEM

FIELD OF THE INVENTION

The present invention provides an improved fluid delivery system which has particular utility in delivering a liquid over an extended vertical distance.

BACKGROUND OF THE INVENTION

A number of applications require the delivery of a liquid or other fluid from one height to another, significantly higher height. In some applications, one can use a positive displacement pump to urge fluid from the lower level to the higher level. So long as the pump has sufficient power to overcome the force of gravity and lift the fluid to the desired height, this is a very effective way to pump fluids to a higher level.

It is not always possible or convenient to provide a positive displacement pump at the lower end of the height to be traversed. In some situations, it may be simply inconvenient to place a pump at the bottom. For example, if the fluid delivery system is used to pump a fluid from the bottom of a deep tank up to the top of that tank, it may be difficult to gain access to the pump at the bottom of the tank for routine maintenance or repair.

In other circumstances, it may be impossible or highly impractical to try to place the pump at the lower end of the fluid travel. For example, when one attempts to pump water or other fluids from an underground geologic formation up to ground level, it is impractical to place a suitable pump down into the bore hole used to gain access to the underground formation. Instead, one will typically pump the fluid by drawing a vacuum at ground level and drawing the water or other fluid up through a fluid delivery conduit of some sort.

This can be very effective for materials having relatively low vapor pressures, such as crude oil. With materials having higher vapor pressures, though, it can be difficult to withdraw the material from particularly deep geologic formations because the material will tend to volatilize at the vacuum levels which would be necessary to draw the material up to ground level against the force of gravity.

For example, if one is attempting to pump water from an underground water table which is more than about 20 feet (about 6 meters) below the ground surface, one generally cannot use a vacuum pump. In order to overcome the "head" of the water, i.e., the weight of the column of water, over such a vertical distance, one would need to draw a rather substantial vacuum. However, the water will tend to boil at such a low pressure, filling the column with relatively low density water vapor. This can lead to a highly inefficient pumping operation if one can get any water out of the system at all.

The system can be even more problematic if the fluid delivery system is attempting to deliver a liquid which has a higher vapor pressure. For example, ground water can be contaminated with hydrocarbons having relatively high vapor pressures, e.g., gasoline or fuel oil. These contaminants will tend to form a layer of the lighter hydrocarbon material on top of the water table. One can try to remove this layer of hydrocarbon by pumping the top layer of the underground fluid up through a delivery conduit. If the hydrocarbon being extracted has a relatively high vapor pressure, though, this can make effective recovery rather difficult.

SUMMARY OF THE INVENTION

One embodiment of the present invention provides a fluid delivery system which includes a pump, a fluid conduit and a regulated gas inlet. The fluid conduit has an upper end operatively connected to the pump and a lower end having a fluid inlet in communication with a fluid supply. The upper end of the fluid conduit is located higher than the lower end.

The regulated gas inlet of this embodiment includes a gas supply maintained at a predictable pressure, a pressure monitoring conduit, a gas delivery conduit and a pressure-responsive valve. The pressure monitoring conduit is in fluid communication with the fluid conduit at an intermediate location positioned between the upper and lower ends of the fluid conduit. The gas delivery conduit is in fluid communication with the fluid conduit at a location between the upper end and the intermediate location. The pressure-responsive valve is operatively connected to the pressure monitoring conduit and moves between a closed position and at least one open position. In its closed position, the valve restricts the flow of gas from the gas supply into the fluid conduit through the gas delivery conduit. In its open position or positions, the valve allows gas to be delivered from the gas supply to the fluid conduit through the gas supply conduit. The valve is normally biased toward the closed position, but moves to one of the open positions when pressure within the pressure monitoring conduit is below the pressure of the gas supply by more than a predetermined level.

Another, somewhat more specialized embodiment of the invention provides a pump for recovering an underground liquid through a bore hole. This embodiment includes a pump positioned above a fluid level of the underground liquid, a fluid conduit and a regulated gas inlet. The fluid conduit has an upper end which is operatively connected to the pump and a lower end which has a fluid inlet in communication with the underground liquid. The regulated gas inlet of this embodiment may be generally the same as that outlined in connection with the previous embodiment.

The invention also contemplates a third embodiment which is somewhat more specialized than either of the other two embodiments. In particular, this embodiment provides a skimmer pump system for recovering an underground liquid through a bore hole. This skimmer pump system includes a pump positioned above the fluid level of the underground liquid, such as at ground level. It also includes a float designed to positioned a fluid inlet carried on the float adjacent the underground liquid fluid level. A fluid conduit has an upper end operatively connected to the pump, with an upper length of the fluid conduit being relatively rigid and a lower length being relatively flexible. The lower length is operatively connected to the fluid inlet of the float.

This system also includes a pressure monitoring conduit in fluid communication with the fluid conduit at an intermediate location disposed between the upper and lower ends of the fluid conduit. A gas delivery conduit is in fluid communication with the fluid conduit at a location between the upper end of the fluid conduit and the intermediate location where the pressure monitoring conduit is connected.

This embodiment also includes a shuttle slidably received in a shuttle tube. The shuttle tube has an opening in fluid communication with the pressure monitoring conduit at one location, an opening in fluid communication with ambient atmosphere at a second location, an opening in fluid communication with the gas delivery conduit at a third location and an ambient air inlet port at a fourth location. The shuttle is received in the shuttle tube between the first and second locations along the tube. The shuttle moves between a closed position and at least one open position in response to a pressure differential between the pressure in the pressure monitoring tube and ambient atmospheric pressure. The shuffle's closed position restricts delivery of air from the ambient air inlet port of the shuttle tube to the gas delivery conduit. The shuttle in its open position delivers gas from the ambient air inlet port to the gas delivery conduit.

DETAILED DESCRIPTION OF THE PREFERRED EMBODIMENTS

Figure 1:
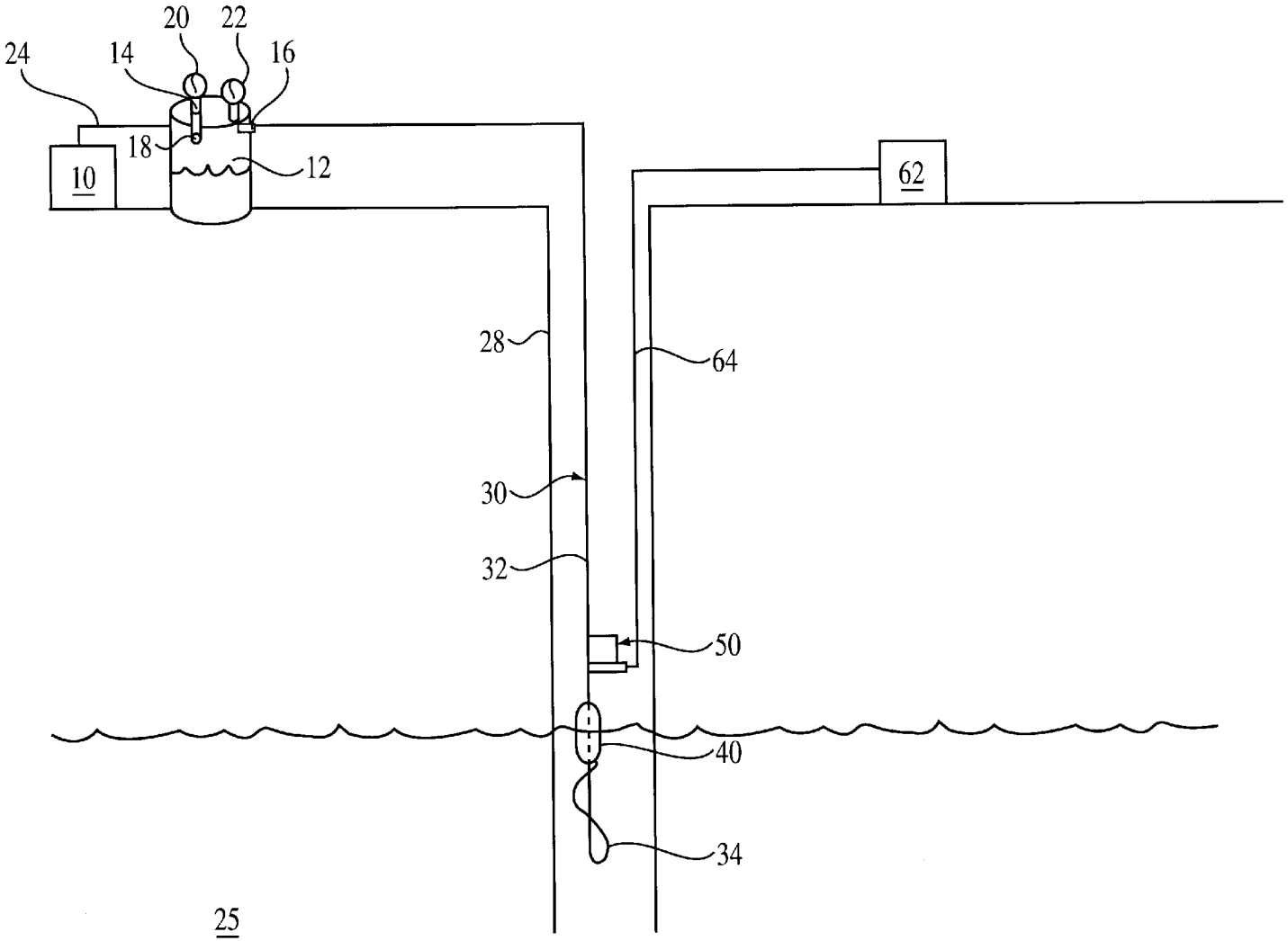
FIG. 1 is a schematic view of a fluid delivery system in accordance with the present invention utilized in connection with a bore hole to withdraw an underground liquid.

FIG. 1 schematically illustrates one embodiment of a fluid delivery system in accordance with the present invention. FIG. 1 illustrates this fluid delivery system used in connection with delivering an underground liquid and much of the following discussion also explains the invention in that context. However, it should be understood that the present invention can be used in connection with delivering other fluids over relatively high vertical distances. For example, the present invention may find use in delivering fluids from underground storage tanks or skimming fats from the surface of a liquid in food processing applications.

The fluid delivery system 10 illustrated in FIG. 1 generally includes a pump 10, a fluid delivery conduit 30, and a regulated gas inlet 50. The fluid conduit 30 has an upper end which is in fluid communication with the pump 10 and a lower end which is in fluid communication with a fluid supply, such as an underground water reservoir 25. The regulated gas inlet 50 is in fluid communication with the fluid conduit at a space positioned between the upper and lower ends, as explained more fully below.

The pump 10 may be of any suitable type which is capable of drawing a vacuum on the fluid delivery conduit 30. For example, the pump may be a standard diaphragm pump with an appropriate rating or a peristaltic pump, though peristaltic pumps are less desirable due to increased maintenance problems for the hosing used in most such pumps. In at least one intended application wherein the invention is used to recover hydrocarbons from a water table, a diaphragm pump which is capable of pumping about 1.5 $ft^3$ of air per minute (about 0.04 $m^3$/min) at a vacuum of up to about 26" Hg (about 88 kPa) should achieve suitable flow rates.

In the embodiment schematically shown in FIG. 1, the pump includes a fluid collection reservoir 12 for collecting the fluid withdrawn from the fluid supply 25. This reservoir 12 is typified by a simple oil drum or the like, with a vacuum line 24 connecting the pump to a first fitting 14 at the top of the reservoir. The upper end of the conduit 30 can also be connected to the reservoir using a fitting 16. As the vacuum line 24 pulls a vacuum on the reservoir 12, this will, in turn, draw a vacuum on the fluid delivery conduit 30. In order to avoid inadvertently delivering the fluid collected in the reservoir 12 to the pump 10, which may damage the pump, one can include a floating check valve 18 which will float on top of the fluid level and close the fitting 14 if the fluid level gets too high and risks being drawn into the vacuum line 24. If so desired, pressure can be monitored with a pressure gauge 20 or the like and temperature within the reservoir 12 can be monitored with a temperature gauge 22 or the like.

The fluid delivery conduit 30 may have any suitable construction. In some applications, a simple flexible hose hanging down in the borehole 28 will suffice. At higher vacuum levels, a flexible hose may tend to crimp down or collapse on itself if the hoop strength of the hose is not high enough. Accordingly, care should be taken to ensure that the walls have sufficient strength to withstand the anticipated vacuum levels applied to the conduit 30 by the pump 10. One can ordinarily provide a sufficiently strong conduit 30 by simply using a relatively rigid, straight pipe formed of metal or a rigid plastic such as polyvinyl-chloride. Sections of such pipe may be joined end-to-end with appropriate seals to provide a fluid conduit 30 of the desired length.

Figure 2:
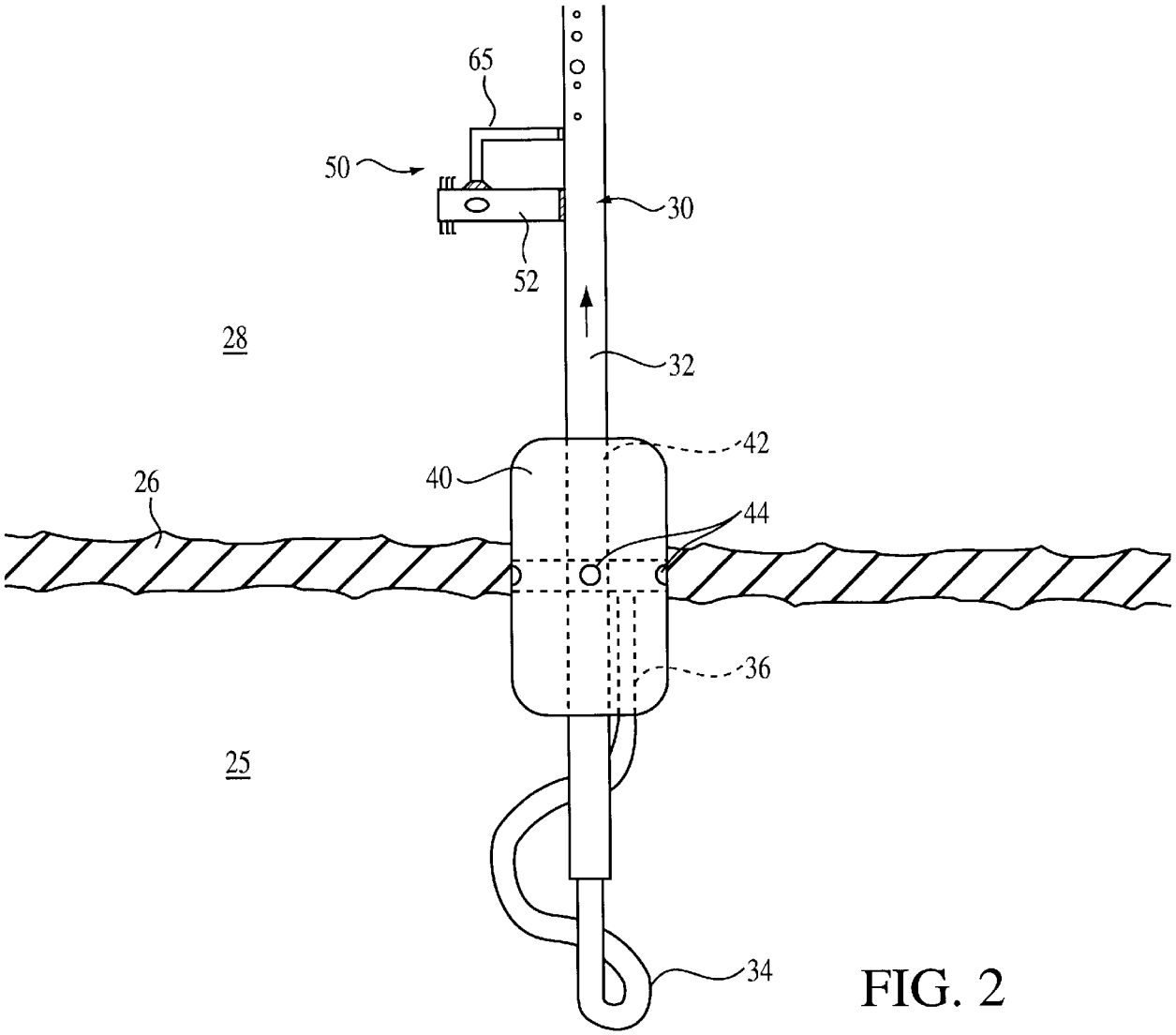
FIG. 2 is a schematic view of a preferred embodiment of the lower portion of a fluid delivery system in accordance with the present invention.

In one particular preferred embodiment, though, the fluid conduit 30 includes a relatively rigid upper length 32, a relatively flexible lower length 34 and a float 40. (These elements are best seen in FIG. 2.) The upper end of the upper length 32 of this conduit is in fluid communication with the pump 10 such as through reservoir 12. The lower end of the upper length 32 is joined to one end of the lower length. The junction between these two lengths is desirably substantially fluid-tight. This can be accomplished in any variety of ways. For example, the lower end of the upper length 32 and the mating end of the lower length 34 can be provided with complimentary fittings designed to provide a fluid-tight seal.

The lower length 34 can be made of a wide variety of materials. As noted above, though, it is important to make sure that the hoop strength is sufficient to maintain the conduit in an open condition under the anticipated operating vacuum within the conduit 30. For example, a high density polypropylene tubing should suffice. If the operating environment is fairly harsh and is likely to chemically attack the lower length 34, a hose made of Tygon™ or the like can be used instead.

The fluid inlet of the fluid conduit 30 can simply comprise an open end of the conduit immersed in the fluid to be drawn through the conduit. In accordance with one embodiment of the present invention, though, the fluid inlet is carried by a float 40. As best seen in FIG. 2, the float comprises a buoyant body with at least one fluid inlet 44 carried thereon. In this embodiment, a plurality of such fluid inlets are spaced about the periphery of the float and are all in fluid communication with one another. The end 36 of the lower length 34 of the conduit is in fluid communication with each of the joined-together fluid inlets 44. As a vacuum is drawn on the fluid conduit 30, this will aspirate fluid into the inlets 44 and to the fluid conduit 30.

The advantage of this embodiment to the invention is that the float permits one to position the fluid inlets 44 adjacent the upper surface of the underground liquid 25. This can be used, for example, to recover contaminants which float on the water table. The underground liquid 25 may comprise water with a thin layer 26 of a hydrocarbon material which is to be recovered. For example, a thin layer of oil may float on the top of the water table in underground formations. If one wishes to recover that hydrocarbon, the float can be optimized to float where the inlets 44 are positioned within and, perhaps, extend slightly below the hydrocarbon layer 26. This will minimize the amount of water which is collected while maximizing the ability to skim the hydrocarbon layer 26 from the surface of the water.

The float can be permitted to simply drift on top of the water within the borehole. In the preferred embodiment shown in the drawings, though, the float 40 has a guideway 42 passing there through. If the float is generally oblong in shape, the guideway 42 may be oriented to pass through the center of the float along its major longitudinal axis, as shown in FIG. 2. The float should be relatively free to move up and down along the upper length 32 of the fluid conduit. The relatively flexible lower length 34 of this conduit allows the float to move up and down within a fairly broad range without restricting the flow of fluid through the conduit.

If so desired, the float 40 and a lower portion of the fluid conduit 30 can be encased within a housing (not shown). This housing may comprise, for example, a simple polyvinyl chloride pipe having a suitable diameter. In order to permit the free flow of fluid to the fluid inlets 44, and particularly to permit the hydrocarbon layer 26 to remain in good fluid contact with those inlets, the housing may include a plurality of slots. These slots should be wide enough to allow fluid to flow in and out of the housing with ease.

As noted above, the fluid delivery system 10 of the invention also includes a regulated gas inlet 50. For reasons explained in more detail below, this gas inlet 50 is adapted to introduce a gas into the fluid within the fluid conduit 30 when the pressure in the fluid conduit 30 drops below a predetermined level.

Figure 3:
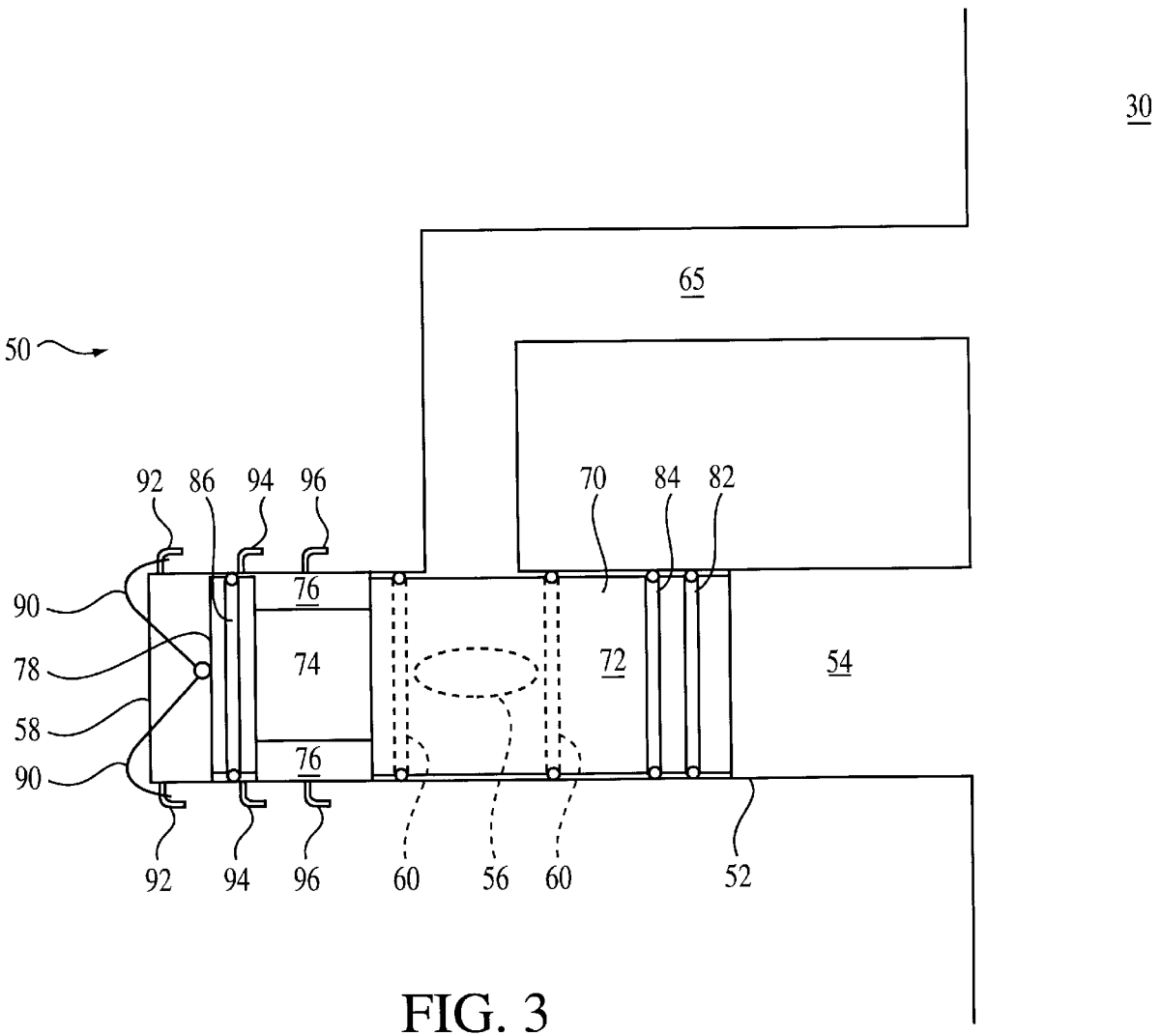
FIG. 3 is a schematic cross-sectional, isolational view of a regulated gas inlet for use in connection with the invention shown in FIG. 2.

One preferred embodiment of a regulated gas inlet 50 is best seen in FIG. 3. In this embodiment, the inlet 50 includes a shuttle 70 received within a shuttle tube 52. As explained in more detail below, the shuttle 70 slides within the shuffle tube 52 and functions as a pressure-responsive valve.

The shuttle tube 52 has an opening in fluid communication with the fluid conduit 30. In the illustrated embodiment, this fluid communication is accomplished by extending the shuttle tube 52 off to one side of the fluid conduit 30. The length of the shuttle tube between the fluid conduit and the shuttle 70 can be considered a pressure monitoring conduit 54 as the pressure in this length of the shuttle tube will allow one to actively monitor the pressure within the fluid conduit 30 at that location along its length. The shuttle tube also includes a gas inlet port 56. As explained more fully below, a gas which is to be introduced into the fluid conduit 30 is drawn into the shuttle tube 52 through this inlet 56.

The shuttle tube 52 is also in fluid communication with a gas supply maintained at a fairly controlled pressure. In the embodiment shown in FIG. 1 this gas supply may comprise a compressor 62 or a pressurized tank of gas positioned adjacent to ground level. An elongate hose 64 may be used to connect the compressor 62 to the shuttle tube 52. By controlling the pressure in the hose 64 delivered by the compressor 62, one can regulate and effectively maintain a desired pressure on the side of the shuttle 70 opposite the pressure monitoring conduit 54.

In the preferred embodiment shown in FIG. 3, though, there is no need for a separate compressor. Instead, ambient air adjacent the regulated gas inlet 50 is used as the gas supply. Obviously, the pressure of ambient air will vary with changes in atmospheric pressure. However, it is believed that these variations are within acceptable limits and the regulated gas inlet 50 of FIG. 3 will operate as intended despite these fluctuations. As typified in FIG. 3, the end 58 of the shuttle tube dispose farthest away from the fluid conduit 30 is simply open to ambient atmosphere.

The regulated gas inlet 50 also includes a gas delivery conduit 65. This conduit is in fluid communication with both the shuttle tube 52 and the fluid conduit 30. As explained below, the gas delivery conduit 65 is used to introduce gas into the fluid conduit to regulate the pressure within the conduit.

The shuffle tube 52 optionally includes a pair of O-rings 60, with one O-ring positioned on either side of the ambient air inlet port 56. This will help provide a fluid-tight seal between the outer surface of the shuttle 70 and both the pressure monitoring conduit 54 and ambient atmosphere through the end 58 of the tube. It is possible that such O-rings could impede the smooth movement of the shuttle 70 in the shuttle tube 52 because the shoulder of the shuttle adjacent the reduced diameter segment 74 (discussed below) could catch on the O-ring, particularly when moving to the shuffle's closed position shown in FIG. 3. To minimize any interference between the O-rings 60 and the shuttle, the O-rings may be positioned at an angle within the tube (presenting a less abrupt interface), for example.

Figure 4:
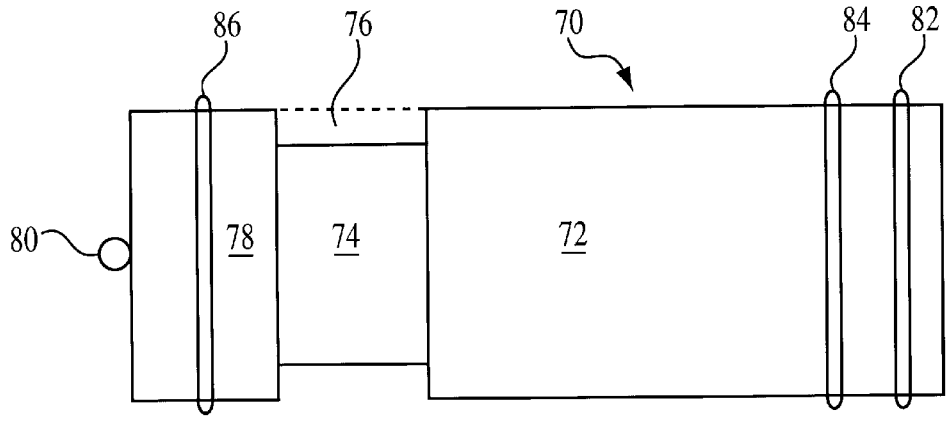
FIG. 4 is a side view of one suitable shuttle for use in the regulated gas inlet of FIG. 3.

The shuttle 70 is adapted to the slide within the shuttle tube 52 between an open position wherein it restricts delivery of gas from the inlet port 56 to the gas delivery conduit 65 and an open position wherein gas is free to flow into the gas supply conduit and, hence, into the fluid conduit 30. As best seen in FIG. 4, the shuttle 70 desirably includes a body 72 and a passageway 76 for delivering gas from the gas inlet port 56 to the gas supply conduit 65. (The operation of this passageway 76 will be explained more fully below.) In the embodiment shown in FIGS. 3 and 4, the passageway 76 is defined by a reduced diameter section 74 of the shuttle. The difference in diameter between the body 72 and the reduced diameter portion 74 defines an annular space between the reduced diameter portion and the inner wall of the shuttle tube 52. Opposite the main body 72, the shuttle desirably also includes a second area 78 which has substantially the same diameter as that of the main body 72.

The shuttle may also include one or more O-rings to help seal the shuttle against the inner surface of the shuttle tube 52. In the embodiment shown in FIG. 4, there are two spaced-apart O-rings 82, 84 carried by the body 72 of the shuttle adjacent the end positioned next to the pressure monitoring conduit 54. This will help provide a fluid-tight seal between the pressure monitoring conduit 54 and the rest of the shuttle tube 52 so that the fluid within the fluid conduit 30 does not escape.

Another O-ring 86 may also be positioned adjacent the opposite end of the shuttle, as shown in FIG. 4. This will help seal the shuttle from the ambient atmosphere entering the open end 58 of the shuttle tube. This will prevent the undesired ingress of air into the gas delivery conduit 65 through the open end 58 of the shuttle tube. If so desired, two or more spaced-apart O-rings could be used instead of the single one shown in FIG. 4.

The shuttle should be free to move within the shuttle tube 52. However, in a particularly preferred embodiment, the shuttle is biased by a spring toward the closed position shown in FIG. 3. The spring may take any useful shape. In the illustrated embodiment, the spring simply comprises a pair of elastic members 90 attached to an eyelet 80 on the second end portion 78 of the shuttle. These elastic members may be attached to the shuttle tube itself to provide a physical reference for the position of the shuttle 70 within the tube. For example, each of the elastic members 90 can be attached to a hook 92 provided on the exterior surface of the shuttle tube.

If one desires to provide the regulated gas inlet 50 with the ability to adjust the pressure at which gas is introduced into the fluid conduit 30, additional hooks 94, 96 can be positioned at different points along the length of the outside of the shuttle tube 52. By moving the elastic members 90 to different hooks, one can adjust the biasing force exerted on the shuttle by the elastic members 90.

When the shuttle 70 is in its closed position, the main body 72 of the shuttle will substantially fill the lumen of the tube 52 adjacent the air inlet port 56. Some air may be permitted to enter the shuttle tube 52 through the inlet port 56 and travel to the gas delivery conduit 65 through the small space between the shuttle and the inner surface of the tube in that area. However, such leakage into the gas delivery tube 65 should be negligible and should have no substantial impact on operation of the system. The O-rings 60 positioned on the inside of the shuttle tube 52 will also help prevent the introduction of air from other areas of the shuttle tube 52.

As the pressure within the fluid conduit 30 drops, the pressure of the ambient air on the second end of the shuttle 70 will tend to urge the shuttle away from the open end of the shuttle tube and toward the fluid conduit 30. In FIG. 3, this would mean urging the shuttle toward the right.) The pressure of the ambient air entering through the open end 58 of the tube 52 will be counteracted to some extent by the resilient members 90. When the force exerted on the shuttle 70 by the pressure differential between ambient air and the pressure in the pressure monitoring conduit 54 exceeds the force exerted by the resilient members 90, the shuttle will move to the right. When the pressure differential is great enough, at least a portion of the reduced diameter portion 74 of the shuttle will be positioned between the two O-rings 60, 60 carried on the inner surface of the shuttle tube 52. This will provide a passageway 76 for gas, i.e., ambient air, to pass between the ambient air inlet port 56 and the gas delivery conduit 65. This defines an open position of the shuttle 70 within the shuttle tube 52.

Figure 6:
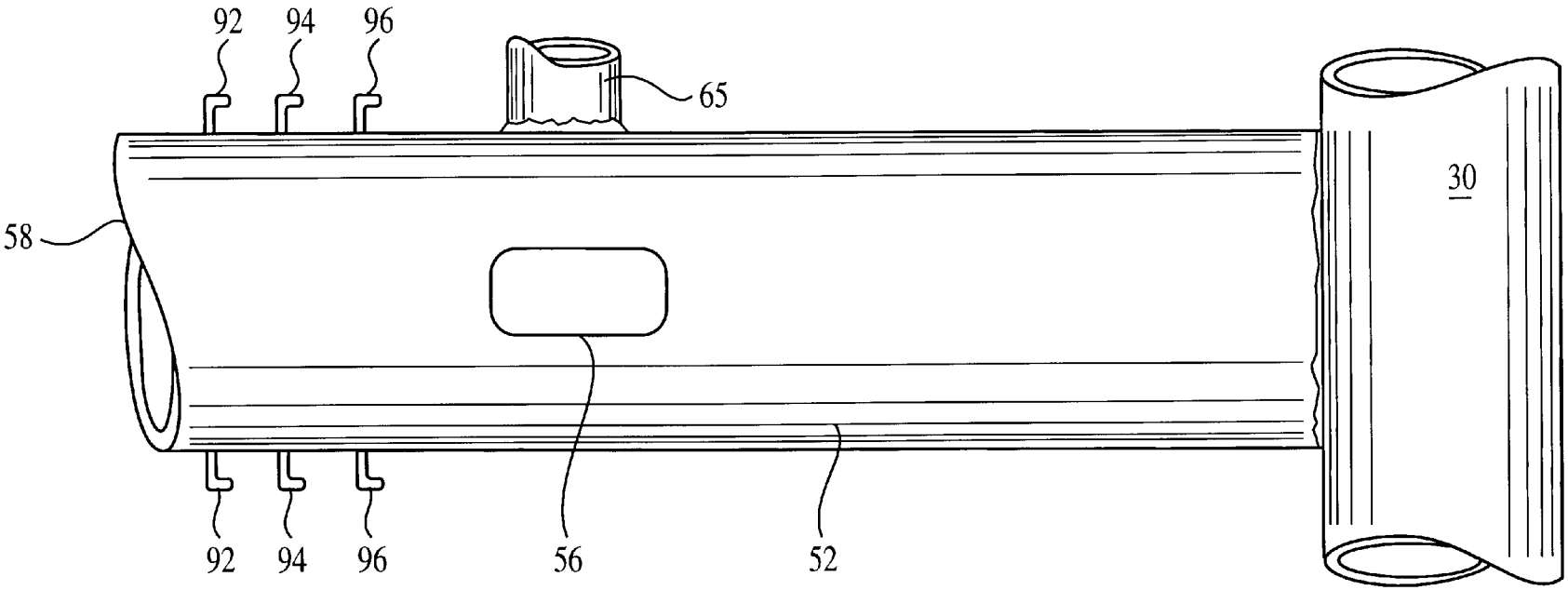
FIG. 6 is a schematic isolational view of a shuttle tube for use in the regulated gas inlet illustrated in FIG. 3.

The shuttle and shuttle tube of the embodiment of FIGS. 3, 4 and 6 essentially operates as a pressure-responsive valve. In particular, the relative positions of the shuttle 70 and the shuttle tube 52 define the closed position wherein the flow of gas from the gas supply (e.g. ambient air) into the fluid conduit through the gas delivery conduit 65 is restricted. The relative positions of the shuttle and shuttle tube also define a number of open positions wherein gas from the gas supply is delivered to the fluid conduit 65. It is difficult to define a single open position of the shuttle within the shuttle tube because any location which permits gas to enter the passageway 76 through the inlet 56 will introduce gas into the gas delivery conduit 65. It should be noted, though, that the more the shuttle moves toward the pressure monitoring conduit 54 (i.e., to the right in FIG. 3) the more readily that gas will flow through this passageway because more of the passageway will be open to the inlet port 56 and the gas delivery conduit 65.

In the embodiment shown in FIG. 3, the gas delivery conduit 65 is connected to the fluid conduit 30 at a location slightly above the position at which the shuttle tube is connected to the fluid conduit. This introduces gas into the fluid conduit 30 upstream of the pressure monitoring conduit 54. As a result, the compressible gas will not pass by the pressure monitoring conduit 54 and this conduit will remain filled with a non-compressible fluid, improving control of the pressure in the fluid conduit 30.

In an alternative embodiment, the gas delivery conduit 65 is connected to the fluid delivery conduit at a location below the pressure monitoring conduit. Ideally, this connection is positioned well below the pressure monitoring conduit 54. For example, if the system is being used to deliver an underground liquid, the gas delivery conduit 65 can be connected to the fluid delivery conduit 30 below the level of the underground liquid. It is believed that this would obviate the need for the O-rings 60 carried by the shuttle tube 52—the pressure in the gas delivery conduit would be greater than the pressure in the pressure monitoring conduit 54 and the O-rings 82, 84 and 86 on the shuttle should suffice to seal the shuttle from the pressure monitoring conduit 54 and ambient environment.

If so desired, an O-ring(not shown) can be provided adjacent the end of the gas delivery conduit which is connected to the shuttle tube 52. This will minimize any interference with movement of the shuttle within the tube while still helping seal the gas delivery conduit against an outer surface of the shuttle 70.

If the gas delivery conduit is positioned below the pressure monitoring conduit 54 in this manner, the introduction of the gas through the gas delivery conduit 65 would reduce the vacuum level in the fluid conduit 30 before the fluid passes the pressure monitoring conduit 54. The discrete pockets of gas introduced into the conduit 30 would appear to cause the pressure in the pressure monitoring conduit 54 to fluctuate more widely, causing the shuttle 70 to pulsate somewhat in the shuttle tube 52. This will tend to introduce smaller bubbles of gas more frequently, which may benefit operation by providing a more consistent output than if there were larger, more discrete pockets of gas in the fluid delivery conduit 30.

Figure 5A:
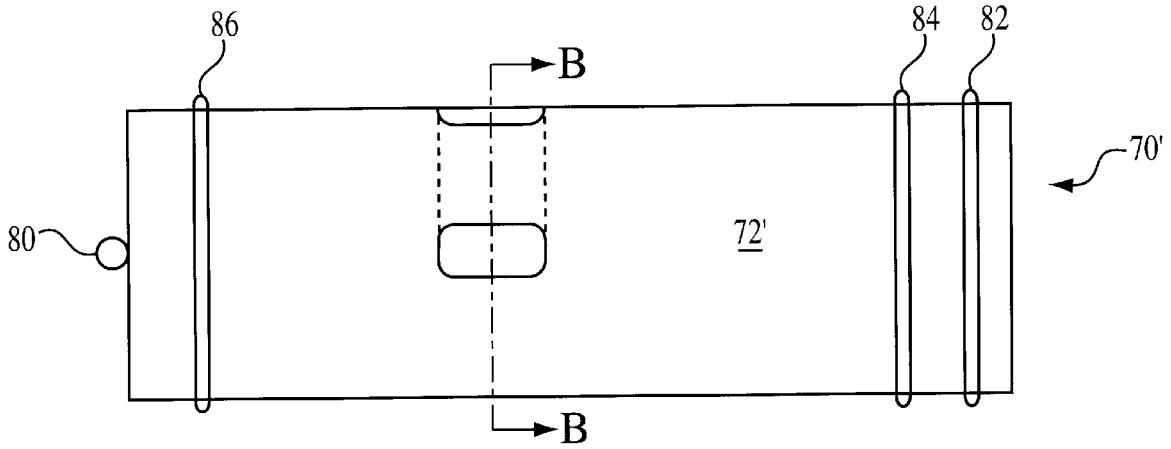
FIG. 5A is a side view of an alternative embodiment of a shuttle which can be used in the regulated gas inlet of FIG. 3.
Figure 5B:
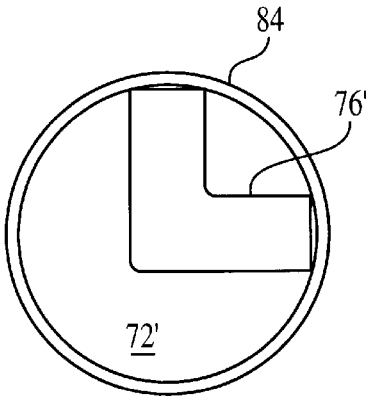
FIG. 5B is a cross-sectional view of the shuttle of FIG. 5A taken along line B—B.

FIGS. 5A and 5B illustrate an alternative embodiment of a shuttle 70'. In this embodiment, the main body 72' of the shuttle 70' may have a substantially constant diameter along its length. For the shuttle in FIG. 4, the reduced diameter segment 74 was used to define a passageway 76 for delivery of gas to the gas conduit 65. In the embodiment of FIG. 5, though, there is no reduced diameter portion 74.

Instead, the body 72' of the shuttle is provided with a passageway 76' passing through the body. In the illustrated embodiment, this is typified by a generally L-shaped passageway having a port on the side and top of the shuttle. When the shuttle 70' is in its open position within the shuttle tube 52, at least a portion of the opening on the side of the shuttle would be aligned with the air inlet port 56 of the shuttle tube. At the same time, at least a portion of the upper opening of the passageway 76' would be aligned with the bottom of the gas delivery conduit 65. This would permit gas to flow between the inlet 56 and the gas conduit 65 through the passageway 76'.

Delivery gas to the fluid conduit 30 through the gas delivery conduit 65 will help significantly improve the flow of liquid through the fluid conduit 30. If the distance which one needs to lift the liquid is relatively short, the vacuum levels necessary to overcome the head of the liquid generally will not be very substantial. If one attempts to lift the liquid through the fluid delivery conduit a greater distance, though, the vacuum pressures necessary to lift the liquid may be more significant.

For materials having low vapor pressure (e.g., crude oil), high vacuum levels, i.e., low pressures, within the fluid delivery conduit 30 will not present a problem. For materials that have higher vapor pressures, including water, the effects of the vacuum in the fluid delivery conduit 30 can be more problematic. In particular, the liquid within the conduit may be caused to boil when the pressure drops below a specific level. When the fluid begins to boil, the pump will be extracting primarily vapors rather than the liquid intended to be extracted. This will substantially adversely impact the flow rate of liquid through the conduit 30 and may effectively preclude one from pumping the liquid through the fluid delivery conduit.

For this reason, many pumps intended to pump water from an underground formation provide the pump at the bottom of the fluid conduit rather than at the top. Since one is, therefore, lifting the water by increasing the pressure at the bottom rather than reducing the pressure at the top, the vapor pressure of water does not present a problem. If one attempts to raise water more than about 20 feet (about 6 meters) using a vacuum at the upper end of that length, though, the vacuum levels necessary to overcome the head of that length water will typically cause the water to boil. This effectively precludes one from using a vacuum pump to lift underground water more than about 20 feet (about 6 meters).

The present invention allows one to pump fluids using a vacuum line across a much greater height. This is accomplished by introducing gas into the fluid delivery conduit 30 when the pressure within that conduit gets too low. The introduced gas will typically form a pocket within the fluid delivery conduit. The introduction of gas into the conduit above the pressure monitoring conduit 54 will help reduce the pressure sensed in that conduit 54. This will, in turn, allow the shuttle 70 to move to its closed position and terminate the introduction of gas into the fluid conduit 30. In this manner, one will typically introduce a series of spaced-apart pockets of gas into the fluid delivery conduit.

Introducing spaced-apart gas pockets into the fluid delivery conduit 30 helps reduce the weight of the fluid within the conduit by reducing the net density of that fluid. Reducing the weight, in turn, reduces the vacuum level necessary to lift the fluid within the conduit 30 up to the reservoir 12. Obviously, introducing the gas into the fluid delivery conduit will reduce the pumping efficiency somewhat as compared to having the entire fluid delivery conduit 30 filled with the liquid at the same flow rate. However, introducing gas in this manner will allow one to lift a liquid a much greater distance without causing the liquid to volatilize and effectively terminate pumping all together.

The amount of gas introduced into the fluid conduit can be controlled by controlling the pressure differential between the gas supply and the fluid delivery conduit 30 necessary to move the pressure-sensitive valve of the system to its open position. In the embodiment shown in FIGS. 3–6, this can be accomplished by adjusting the tension on the elastic members 90. If the elastic members are attached to the first pair of hooks 92, the biasing force exerted by the elastic members will be incrementally lower than if the same elastic members were attached to the second pair of hooks 94 or the third pair of hooks 96.

Lowering the biasing force exerted on the shuttle 70 will allow the shuttle to move to its open position when the pressure differential between ambient air and the pressure monitoring conduit 54 is relatively low. Increasing the biasing force of the elastic members 90 will increase the pressure differential necessary to move the shuttle to its open position and introduce gas into the fluid conduit 30. By adjusting the necessary pressure differential in this manner, one can ensure that gas will be introduced into the fluid delivery conduit 30 before the pressure in the conduit drops below the level necessary to volatilize the liquid being recovered. At the same time, one need not set the shuttle to open at unnecessarily low pressure differentials, which would more readily introduce gas and yield a corresponding reduction in pumping efficiency.

While a preferred embodiment of the present invention has been described, it should be understood that various changes, adaptations and modifications may be made therein without departing from the spirit of the invention and the scope of the appended claims.

What is claimed is:

1. A fluid delivery system comprising:

a) a pump;

b) a fluid conduit having an upper end operatively connected to the pump and a lower end having a fluid inlet in communication with a fluid supply, the upper end of the fluid conduit being located higher than the lower end;

c) a regulated gas inlet comprising a gas supply maintained at a first pressure; a pressure monitoring conduit in fluid communication with the fluid conduit at an intermediate location disposed between said upper and lower ends; a gas delivery conduit in fluid communication with the fluid conduit at a location between the upper end and the intermediate location; and a pressure-responsive valve operatively connected to the pressure monitoring conduit and moving between a closed position wherein flow of gas from the gas supply into the fluid conduit through the gas delivery conduit is restricted, and at least one open position wherein gas from the gas supply is delivered to the fluid conduit through the gas supply conduit, the valve being normally biased toward the closed position but moving to the open position when pressure within the pressure monitoring conduit is below the first pressure by more than a predetermined level.

2. The fluid delivery system of claim 1 wherein the gas supply comprises atmospheric air in the ambient environment of the gas inlet.

3. The fluid delivery system of claim 1 wherein the pressure-responsive valve comprises a shuttle slidably received in a shuttle tube and moveable therein between a closed position corresponding to the closed position of the valve and at least one open position corresponding to the open position of the valve, the shuttle sealingly engaging an inner surface of the shuttle tube along at least a portion of its length.

4. The fluid delivery system of claim 3 wherein the shuttle tube is open on one side of the shuttle to the pressure monitoring conduit and on an opposite end of the shuttle to ambient atmosphere.

5. The fluid delivery system of claim 3 wherein the shuttle tube includes a gas inlet port through a wall thereof, the shuttle including a passageway for delivering gas from the gas inlet port to the gas supply conduit when the shuttle is in its open position within the shuttle tube.

6. The fluid delivery system of claim 4 wherein the shuttle further comprises a spring for biasing the shuttle toward the closed position, the spring exerting a spring force sufficient to prevent the shuttle from moving into an open position unless a pressure differential between the pressure monitoring circuit and the first pressure exceeds a predetermined threshold.

7. The fluid delivery system of claim 1 wherein the fluid inlet of the fluid conduit is attached to a float designed to position the fluid inlet adjacent an interface between two different fluids.

8. The fluid delivery system of claim 7 wherein the float is designed to float on a body of water and to position the fluid inlet adjacent a layer of a hydrocarbon to be recovered by the fluid delivery system.

9. The fluid delivery system of claim 7 wherein the float has a passageway therethrough, the fluid delivery conduit passing through the passageway of the float.

10. The fluid delivery system of claim 9 wherein the float is permitted to slide along a length of the fluid delivery conduit as it floats on top of a body of liquid.

11. The fluid delivery system of claim 10 wherein the fluid delivery conduit comprises a relatively rigid upper length and a relatively flexible lower length, the lower length being attached adjacent one end to the upper length and adjacent its other end to the float.

12. A pump for recovering an underground liquid through a borehole, comprising:

a) a pump positioned above a fluid level of the underground liquid;

b) a fluid conduit having an upper end operatively connected to the pump and a lower end having a fluid inlet in communication with the underground liquid;

c) a regulated gas inlet comprising a gas supply maintained at a first pressure; a pressure monitoring conduit in fluid communication with the fluid conduit at an intermediate location disposed between said upper and lower ends; a gas delivery conduit in fluid communication with the fluid conduit at a location between the upper end and the intermediate location; and a pressure-responsive valve operatively connected to the pressure monitoring conduit and moving between a closed position wherein flow of gas from the gas supply into the fluid conduit through the gas delivery conduit is restricted, and at least one open position wherein gas from the gas supply is delivered to the fluid conduit through the gas supply conduit, the valve being normally biased toward the closed position but moving to the open position when pressure within the pressure monitoring conduit is below the first pressure by more than a predetermined level.

13. The pump of claim 12 wherein the gas supply comprises atmospheric air in the ambient environment of the gas inlet.

14. The fluid delivery system of claim 12 wherein the pressure-responsive valve comprises a shuttle slidably received in a shuttle tube and moveable therein between a closed position corresponding to the closed position of the valve and at least one open position corresponding to the open position of the valve, the shuttle sealingly engaging an inner surface of the shuttle tube along at least a portion of its length.

15. The pump of claim 12 wherein the shuttle tube includes a gas inlet port through a wall thereof, the shuttle including a passageway for delivering gas from the gas inlet port to the gas supply conduit when the shuttle is in its open position within the shuttle tube.

16. The pump of claim 15 wherein the shuttle tube is open on one side of the shuttle to the pressure monitoring conduit and on an opposite end of the shuttle to ambient atmosphere.

17. The pump of claim 15 wherein the shuttle is in a first position within the shuttle tube when the pressure responsive valve is in its closed position and in a second position within the shuttle tube when the valve is in its open position, the shuttle tube including a gas port through a wall thereof, the shuttle including a shunt for delivering gas from the gas port of the shuttle tube to the gas supply conduit when the shuttle is in its second position within the shuttle tube.

18. The pump of claim 12 wherein the fluid inlet of the fluid conduit is attached to a float designed to position the fluid inlet adjacent the fluid level of the underground liquid.

19. The pump of claim 18 wherein the underground liquid comprises water with a layer of a lighter hydrocarbon floating thereon, the density and configuration of the float being selected to position the fluid inlet adjacent the layer of hydrocarbon.

20. The pump of claim 18 wherein the float has a guideway therethrough, the fluid delivery conduit passing through the guideway of the float.

21. The pump of claim 20 wherein the float is permitted to slide along the length of the fluid delivery conduit as it floats on top of a body of liquid.

22. The pump of claim 21 wherein the fluid delivery conduit comprises a relatively rigid upper length and a relatively flexible lower length, the lower length being attached adjacent one end to the upper length and adjacent its other end to the float.

23. A skimmer pump system for recovering an underground liquid through a borehole, comprising:

a) a pump positioned above a fluid level of the underground liquid;

b) a float designed to position a fluid inlet carried thereby adjacent the fluid level of the underground liquid;

c) a fluid conduit having an upper end operatively connected to the pump, an upper length of the fluid conduit being relatively rigid and a lower length being relatively flexible, the lower length being operatively connected to the fluid inlet of the float;

d) a pressure monitoring conduit in fluid communication with the fluid conduit at an intermediate location disposed between said upper and lower ends of the fluid conduit;

e) a gas delivery conduit in fluid communication with the fluid conduit at a location between the upper end of the fluid conduit and the intermediate location;

f) a shuttle tube having an opening in fluid communication with the pressure monitoring conduit at one location, an opening in fluid communication with ambient atmosphere at a second location, an opening in fluid communication with the gas delivery conduit at a third location and an ambient air inlet port at a fourth location; and g) a shuttle slidably received in the shuttle tube between the first and second locations along the shuttle tube, the shuttle moving between a closed position and at least one open position in response to a pressure differential between the pressure in the pressure monitoring tube and ambient atmospheric pressure, the shuttle in its closed position restricting delivery of air from the ambient air inlet port of the shuttle tube to the gas delivery conduit and in its open position delivering gas from said ambient air inlet port to the gas delivery conduit.

24. The skimmer pump of claim 23 further comprising a spring biasing the shuttle toward the closed position, the biasing force of the spring preventing the shuttle from moving into an open position unless said pressure differential exceeds a predetermined level.

25. The skimmer pump of claim 23 wherein the shuttle sealingly engages an inner surface of the shuttle tube at at least two spaced-apart locations, one of the spaced-apart locations being positioned between the first and third locations along the shuttle tube and the other of the spaced-apart locations being positioned between the second and third locations along the shuttle tube.

26. The skimmer pump of claim 23 wherein the shuttle has a reduced diameter area between two larger diameter areas, the reduced diameter area defining a passageway for fluid to flow between the ambient air inlet port and the gas delivery tube when the shuttle is in an open position.

* * * * *